US006091924A

United States Patent [19]

Bhattacharya

[11] Patent Number: 6,091,924

[45] Date of Patent: Jul. 18, 2000

[54] FUSER RELEASE AGENT MANAGEMENT (RAM) SYSTEM INCLUDING AN EXTERNAL FUSER ROLL HEATER AND AGENT REDISTRIBUTOR

[75] Inventor: Tricia A. Bhattacharya, Rochester, N.Y.

[73] Assignee: Xerox Corporation, Stamford, Conn.

[21] Appl. No.: 09/326,452

[22] Filed: Jun. 7, 1999

[51] Int. Cl.[7] ..... G13L 15/20

[52] U.S. Cl. ..... 399/325; 219/216

[58] Field of Search ..... 399/325; 118/60, 118/101; 219/216; 432/60

[56] References Cited

U.S. PATENT DOCUMENTS 3,810,776 5/1974 Banks et al. ..... 427/194
4,285,295 8/1981 Iwao et al. ..... 118/60
5,212,527 5/1993 Fromm et al. ..... 355/284
5,504,566 4/1996 Chow et al. ..... 355/284

*Primary Examiner*—Joan Pendergrass
*Attorney, Agent, or Firm*—Tallam I. Nguti

[57] ABSTRACT

A fuser release agent management (RAM) system for applying release agent to a fusing apparatus is provided. The Ram system includes an application member for applying release agent to an external surface of a movable internally heated fusing member, and supply source for supplying release agent to the application member. Importantly, the RAM system includes a heating and release agent redistributing member mounted into contact with the external surface of the internally heated fusing member for additionally heating the external surface and release agent thereon, and for redistributing and smoothing out the release agent thereon, thereby eliminating an interdocument agent banding problem, and differential gloss ordinarily created by areas of unredistributed release agent thereon.

6 Claims, 2 Drawing Sheets

FUSER RELEASE AGENT MANAGEMENT (RAM) SYSTEM INCLUDING AN EXTERNAL FUSER ROLL HEATER AND AGENT REDISTRIBUTOR

BACKGROUND OF THE INVENTION

This invention relates generally to electrophotographic printing machines having heat and pressure fusers, and more particularly to such a machine having a fuser release agent management (RAM) system including an external fuser roll heater and agent redistributor member.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip.

The heated fuser roll is usually the roll that contacts the toner images on a substrate such as plain paper. In any event, the roll contacting the toner images is usually provided with an non-adhesive material for preventing toner offset to the fuser member. Three materials which are commonly used for such purposes are PFA™, Viton™ and silicone rubber. All of these materials, in order to maintain their non-adhesive qualities, require release agents specific to the material.

Various methods are known for applying release agent materials to a fuser member such as a heated fuser roll. One such system comprises a Release Agent Management RAM) system including a donor roll which contacts the fuser member to which the oil or release agent material is applied. The donor roll also contacts a metering roll which conveys the oil from a supply of oil to the donor roll. A blade member is provided for metering oil on the metering roll.

In low volume or desktop printers, critical machine features involve the cost and the quantity as well as the duration of required customer service operations. It is advantageous therefore to attempt to keep the number of separate customer replaceable units to a minimum, preferably to only one.

Additionally, in such printers, (especially color ones) where a RAM system is required for reliable fuser operation, conventional RAM systems ordinarily leave uneven amounts of release oil or agent on the external surface of the fuser roller, and particularly in an interdocument area of the surface of the fuser roller. This has been found to cause differential gloss defects on fused toner image copies, especially soon after cycle up when the release oil or agent rate on the fuser roller is still relatively high. This defect usually is exhibited as a low gloss band about 2 inches wide on the fused copy.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,504,566 granted to Chow et al on Apr. 2, 1996 discloses an apparatus for fusing toner images to a substrate. A Release Agent Management (RAM) system for applying silicone oil to a metering roll utilizes a pair of metering blades to improve oil uniformity on the metering roll. Thus, streaks or localized areas of excess silicone oil as the result of blade defects and/or dirt accumulation associated with a first blade, are metered or smoothed to a more uniform thickness by the second blade. To this end, the first metering blade serves to meter silicone oil to a first predetermined thickness while the second blade serves to meter oil streaks to a second predetermined thickness which is greater than the first predetermined thickness.

U.S. Pat. No. 5,212,527 granted to From et al on May 18 discloses a release agent management (RAM) system including a metering roll supported for contact with release agent material contained in a sump. A donor roll is provided for applying oil deposited thereon by the metering roll. A metering blade structure for metering silicone oil onto the metering roll has two modes of operation. In one mode, a wiping action of a metering blade meters a relatively large quantity of silicone oil to the roll surface for accommodating the fusing of color toner images. In another mode of operation, a doctoring action is effected for metering a relatively small amount of silicone oil to the roll surface for accommodating the fusing of black toner images.

BRIEF SUMMARY OF THE INVENTION

According to one aspect of the present invention there is provided a fuser release agent management (RAM) system for applying release agent to a fusing apparatus. The Ram system includes an application member for applying release agent to an external surface of a movable internally heated fusing member, and supply source for supplying release agent to the application member. Importantly, the RAM system includes a heating and release agent redistributing member mounted into contact with the external surface of the internally heated fusing member for additionally heating the external surface and release agent thereon, and for redistributing and smoothing out the release agent thereon, thereby eliminating an interdocument agent banding problem, and differential gloss ordinarily created by areas of unredistributed release agent thereon.

DETAILED DESCRIPTION OF THE INVENTION

Figure 1:
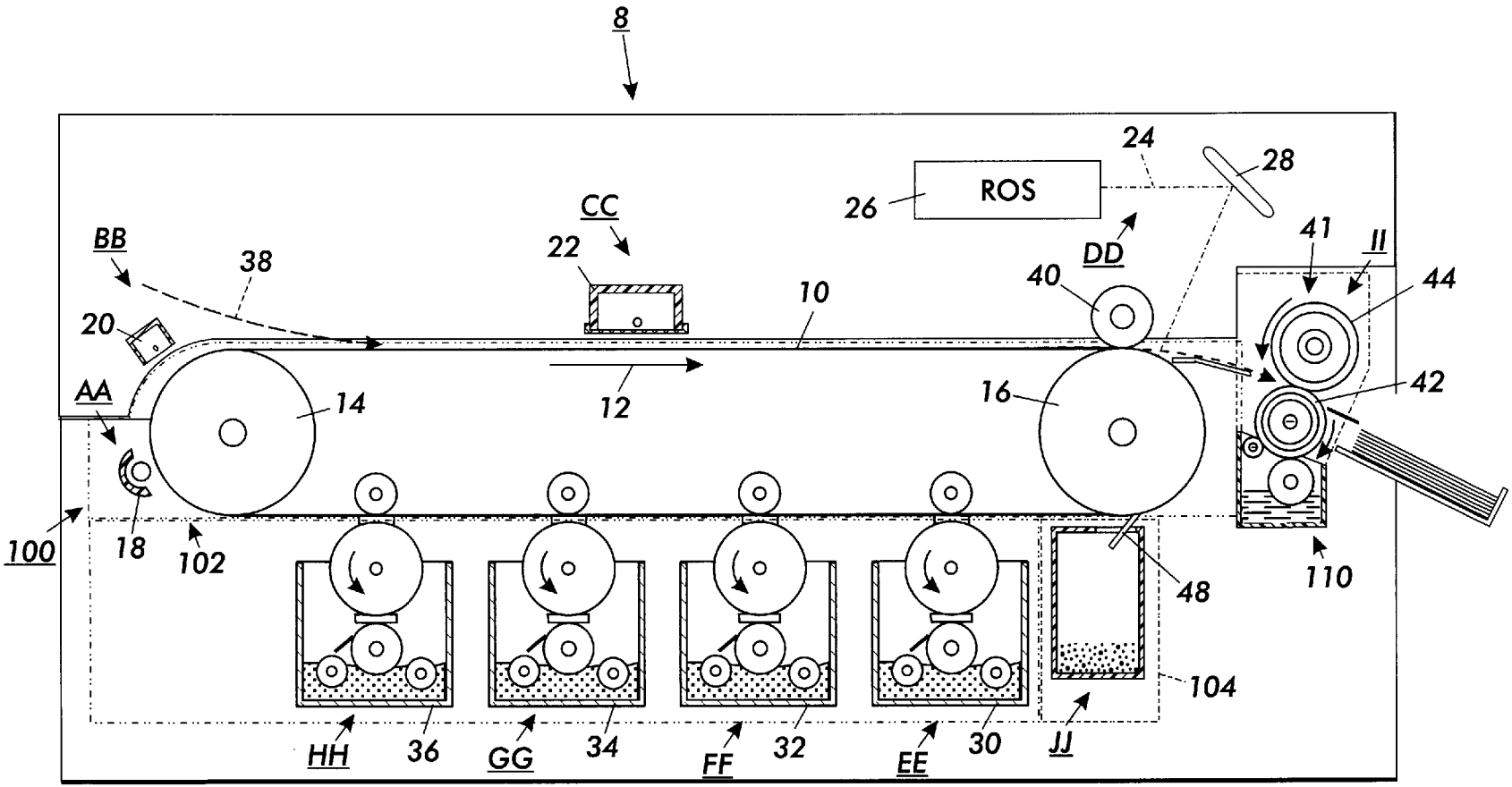
FIG. 1 is a schematic representation of an electrostatographic reproduction machine including the fuser release agent management (RAM) system including an external fuser roll heater and agent redistributor member in accordance with the present invention.
Figure 2:
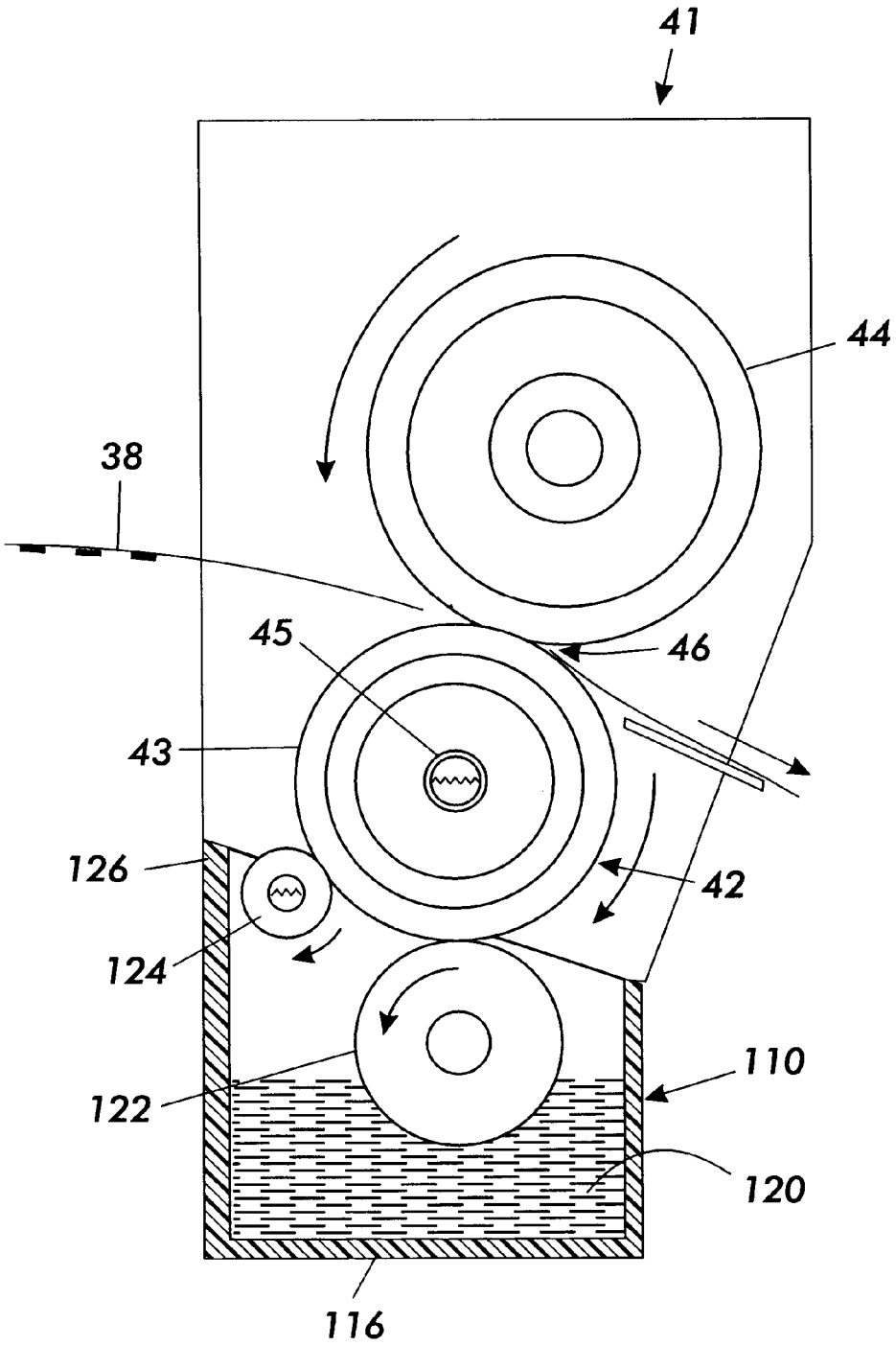
FIG. 2 is an enlarged schematic of the fuser apparatus of the machine of FIG. Including the RAM system of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims. For a general understanding of the features of the present invention, reference is made to the drawings. In the drawings, like reference numerals have been used throughout to identify identical elements.

FIG. 1 illustrates a color electrophotographic printing machine 8 which is suitable for implementing the principles of the present invention. The printing machine 8 may include a main customer replaceable unit (CRU), such as a photoreceptor CRU shown generally as 100. As shown, the CRU 100 includes a frame 102 that has an outer surface 104 contoured for insertion into a cavity (not labeled) within the machine 8.

The CRU 100 may have several electrostatographic process elements including charging elements, erase elements, development elements, a photoreceptor belt or drum, and importantly the life-extending fuser release agent or oil supply assembly 106 of the present invention. For example, the CRU 100 as shown includes an Active Matrix (AMAT) photoreceptor belt 10 which is driven and travels in the direction indicated by the arrow 12 when loaded into the machine 8. Belt travel is brought about by mounting the belt about a drive roller 14 (which is driven by a motor not shown) and a tension roller 16.

As the photoreceptor belt travels each part of it passes through each of the subsequently described process stations and elements. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas since each image area is processed in the same way a description of the processing of one image area suffices to fully explain the operation of the printing machine.

The machine 8 is for example a top transfer color machine in which the production of a color document takes place in 5 cycles. The first cycle begins with the image area passing through an erase station AA. At the erase station AA an erase lamp 18 illuminates the image area so as to cause any residual charge which might exist on the image area to be discharged. Such erase lamps and their use in erase stations are well known. Light emitting diodes are commonly used as erase lamps.

As the photoreceptor belt continues its travel the image area passes through a first charging station BB. At the first charging station BB a corona generating device 20, beneficially a DC pin corotron, charges the image area to a relatively high and substantially uniform potential of, for example, about −700 volts. After passing the corona generating device 20 the image area passes through a second charging station CC which partially discharges the image area to, for example, about −500 volts. The second charging station CC uses an AC scorotron 22 to generate the required ions.

The use of a first charging station to overcharge the image area and a subsequent second charging station to neutralize the overcharge is referred to as split charging. Since split charging is beneficial for recharging a photoreceptor which already has a developed toner layer, and since the image area does not have such a toner layer during the first cycle, split charging is not required during the first cycle. If split charging is not used in the first cycle either the corona generating device 20 or the scorotron 22 corona could be used to simply charge the image area to the desired level of −500 volts.

After passing through the second charging station CC the now charged image area passes through an exposure station DD. At the exposure station DD the charged image area is exposed to the output 24 of a laser based output scanning device 26 and which reflects from a mirror 28. During the first cycle the output 24 illuminates the image area with a light representation of a first color (say black) image. That light representation discharges some parts of the image area so as to create an electrostatic latent representation of the exposing light. For example, illuminated sections of the image area might be discharged by the output 24 to about −50 volts. Thus after exposure the image area has a voltage profile comprised of relatively high voltages of about −500 volts and of relatively low voltages of about −50 volts. After passing through the exposure station DD the exposed image area passes through a first development station EE which deposits a first color of negatively charged toner 30, black, onto the image area.

While the first development station could be a magnetic brush developer, a scavengeless developer may be somewhat better. One benefit of scavengeless development is that it does not disturb previously deposited toner layers. Since during the first cycle the image area does not have a previously developed toner layer, the use of scavengeless development is not absolutely required as long as the developer is physically cammed away during other cycles. However, since the other development station (described below) use scavengeless development it may be better to use scavengeless development at each development station.

After passing through the first development station EE, the image area advances so as to return to the first charging station BB. The second cycle begins. The first charging station BB uses its corona generating device 20 to overcharge the image area and its toner to more negative voltage levels than that which the image area and its first toner layer are to have when they are exposed. At the second charging station CC the AC scorotron 22 reduces the negative charge on the image area by applying positive ions so as to charge the image area.

After passing through the second charging station CC the now substantially uniformly charged image area with its first toner layer advances to the exposure station DD. At the exposure station DD the recharged image area is again exposed to the output 24 of a laser based output scanning device 26. During this cycle the scanning device 26 illuminates the image area with a light representation of a second color (say yellow) image. That light representation discharges some parts of the image area so as to create a second electrostatic latent representation. After passing through the exposure station DD the now exposed image area passes through a second development station FF which deposits a second color of toner 32, yellow, onto the image area. Since the image area has a first toner layer the second development station FF should be a scavengeless developer.

After passing through the second development station FF the image area and its two toner layers returns to the first charging station BB. The third cycle begins. The first charging station BB again uses its corona generating device 20 to overcharge the image area and its two toner layers to more negative voltage levels than that which the image area and its two toner layer are to have when they are exposed. The second charging station CC again reduces the image area potentials. The substantially uniformly charged image area with its two toner layers then advances again to the exposure station DD. At exposure station DD the image area is again exposed to the output 24 of the laser based output scanning device 26. During this cycle the scanning device 26 illuminates the image area with a light representation of a third color (say magenta) image. That light representation discharges some parts of the image area so as to create a third electrostatic latent representation.

After passing through the exposure station DD the third time the image area passes through a third development station GG. The third development station GG, preferably a scavengeless developer, advances a third color of toner 34, magenta, onto the image area. The result is a third toner layer on the image area.

The image area with its three toner layers then advances back to the charging station BB. The fourth cycle begins. The first charging station BB once again uses its corona generating device 20 to overcharge the image area (and its three toner layers) to more negative voltage levels than that which the image area is to have when it is exposed (say about −500 volts). The second charging station CC once again reduces the image area potentials to about −500 volts. The substantially uniformly charged image area with its three toner layers then advances yet again to the exposure station DD. At the exposure station DD the recharged image area is again exposed to the output 24 of the laser based output scanning device 26. During this cycle the scanning device 26 illuminates the image area with a light representation of a fourth color (say cyan) image. That light representation discharges some parts of the image area so as to create a fourth electrostatic latent representation.

After passing through the exposure station DD the fourth time the image area passes through a fourth development station HH. The fourth development station, also a scavengeless developer, advances a fourth color of toner 36, cyan, onto the image area. This marks the end of the fourth cycle.

After completing the fourth cycle the image area has four toner powder images which make up a composite color powder image. That composite color powder image is comprised of individual toner particles which have charge potentials which vary widely. Indeed, some of those particles have a positive charge. Transferring such a composite toner layer onto a substrate would result in a degraded final image. Therefore it becomes necessary to prepare the charges on the toner layer for transfer.

The fifth cycle begins by passing the image area through the erase station AA. At erase station AA the erase lamp 18 discharges the image area to a relatively low voltage level. This reduces the potentials of the image area, including that of the composite color powder image, to potentials near zero. The image area with its composite color powder image then passes to the charging station BB. During the fifth cycle the charging station BB performs a pre-transfer charging function. The first charging device supplies sufficient negative ions to the image area that substantially all of the previously positively charged toner particles are reversed in polarity. Importantly, positive charges, which because of the polarities used in the subsequently described transfer are the most difficult to transfer, are also reduced to levels near zero.

As the image area continues in its travel past the first charging station BB a substrate 38 is advanced into place over the image area using a sheet feeder (which is not shown). As the image area and substrate continue their travel they pass through the charging station CC.

At charging station CC the second charging device 22 applies positive ions onto the exposed surface of the substrate 38. The positive ions attract the negatively charged toner particles on the image area to the substrate. As the substrate continues its travel the substrate passes a bias transfer roll 40 which assists in attracting the toner particles to the substrate and in separating the substrate with its composite color powder image from the photoreceptor belt 10.

The substrate 38 is then directed into a fuser or fusing apparatus 41 at fusing station 11 where a heated fusing member such as fuser roll 42 and a pressure roller 44 create a nip 46 through which the substrate passes. The heated fusing member or fuser roller 42 preferably is heated internally, for example, by heat lamp 45 and release agent is applied to its surface by the release agent management (RAM) system 110 of the present invention. The combination of pressure and heat at the nip causes the composite color toner image to be heated and fused into the substrate 38.

With conventional RAM systems ordinarily, release oil or agent is left on the external surface 43 of the fuser roller 42, and particularly in an interdocument area of the surface 43. This has been found to cause differential gloss defect on fused toner image copies, especially soon after cycle up when the release oil or agent rate on the fuser roller is still relatively high. This defect usually is exhibited as a low gloss band about 2 inches wide on the fused copy. It was found that an external heater in the form of a roll redistributes and smoothes out release oil or agent left in the interdocument area, thereby eliminating any interdocument release oil or agent banding problems.

Therefore as shown, the fusing apparatus 41 in accordance with the present invention includes a RAM system 110 of the present invention for applying fuser release oil or agent 120 onto an external surface 43 of the fuser roll 42, so as to insure complete high quality release of the fused toner image onto the substrate 38. The Ram system 110 includes a housing 116 as a source of supply of release oil or agent 120, and an application member 122 mounted partially within the housing 116 for receiving and applying release oil or agent to the external surface 43 of the movable internally heated fusing member or roller 42. Importantly, the RAM system includes a heating and release agent redistributing member 124 that is mounted into contact with the external surface 43 of the internally heated fusing member or roller 42.

As shown, the heating and release agent redistributing member 124 is preferably a roller that is heated internally as by a lamp 126, for additionally heating the external surface 43 and release agent thereon, and for redistributing and smoothing out the release agent thereon. Redistributing and smoothing out the release agent on the external surface 43 advantageously eliminates any interdocument agent banding problems, as well as differential gloss which ordinarily would have been created by areas of unredistributed release agent on the external surface 43. After fusing, a chute, not shown, guides the support sheets 38 to a catch tray, also not shown, for removal by an operator.

As previously used the term substrate may seem to mean simply a copy sheet. However, a substrate can also be other types of reception surfaces, specifically including an intermediate transfer member. If an intermediate transfer member is used the second charging station will not be used to transfer the negatively charged toner particles. Rather an intermediate transfer station will be located adjacent the photoreceptor belt after the first charging station. Generally the intermediate transfer station will include a charged intermediate transfer member which will attract the negatively charged toner particles on the intermediate transfer member. However, a printing machine which does not use an intermediate transfer member will usually be lower in cost than one which does use such a member.

After the substrate is separated from the photoreceptor belt 10 the image area continues its travel and eventually enters a cleaning station JJ. At cleaning station JJ a cleaning blade 48 is brought into contact with the image area. That blade wipes residual toner particles from the image area. The image area then passes once again to the erase station AA and the 5 cycle printing process begins again. The various machine functions described above are generally managed and regulated by a controller which provides electrical command signals for controlling the operations described above.

As can be seen, there has been provided an electrostatographic reproduction machine including means including a movable image bearing member for forming and transferring a toner image onto a substrate; a fusing apparatus including a heated fusing member for heating and fusing the toner image onto the substrate; and a fuser release agent management (RAM) system for applying release agent to the fusing apparatus that has a movable internally heated fusing member. Ram system includes an application member for applying release agent to an external surface of the movable internally heated fusing member; supply source for supplying release agent to the application member; and a heating and release agent redistributing member mounted into contact with the external surface of the internally heated fusing member for additionally heating the external surface and release agent thereon, and for redistributing and smoothing out the release agent thereon, thereby eliminating an interdocument oil banding problem and differential.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A fuser release agent management (RAM) system for applying release agent to a fusing apparatus, the Ram system comprising:

(a) an application member for applying release agent to an external surface of a movable internally heated fusing member;

(b) supply means for supplying release agent to said application member; and (c) a heating and release agent redistributing member mounted into contact with the external surface of the internally heated fusing member for additionally heating the external surface and release agent thereon, and for redistributing and smoothing out the release agent thereon, thereby eliminating an interdocument oil banding problem and differential gloss created by areas of unredistributed release agent.

2. The RAM system of claim 1, wherein said heating and smoothing member is a heated rotatable roller relative to a direction of movement of the heated fusing member and relative to said application member.

3. The RAM system of claim 1, wherein said heating and smoothing member is mounted for contacting the external surface of the heated fusing member downstream of said application.

4. The RAM system of claim 1, wherein said heating and smoothing member comprises an internally heated roller.

5. An electrostatographic reproduction machine comprising:

(a) a machine frame;

(b) means mounted to said frame including a movable image bearing member, for forming and transferring a toner image onto a substrate;

(c) a fusing apparatus including a heated fusing member for heating and fusing a toner image onto a substrate; and (d) a fuser release agent management (RAM) system for applying release agent to said fusing apparatus having a movable internally heated fusing member, the Ram system including:

(i) an application member for applying release agent to an external surface of said movable internally heated fusing member;

(ii) supply means for supplying release agent to said application member; and (iii) a heating and release agent redistributing member mounted into contact with said external surface of said internally heated fusing member for additionally heating said external surface and release agent thereon, and for redistributing and smoothing out the release agent thereon, thereby eliminating an interdocument oil banding problem and differential gloss created by areas of unredistributed release agent.

6. The electrostatographic reproduction machine of claim 5, wherein said heating and smoothing member comprises an internally heated roller.

* * * * *